US005299998A

United States Patent [19]

Hutchins

[11] Patent Number: 5,299,998

[45] **Date of Patent: * Apr. 5, 1994**

[54] LINEAR MOVEMENT, TRUNK MUSCLE EXERCISE MACHINE

[76] Inventor: Kenneth M. Hutchins, 350 Hidden Pines Cir., Casselberry, Fla. 32707

[ * ] Notice: The portion of the term of this patent subsequent to Sep. 15, 2009 has been disclaimed.

[21] Appl. No.: 877,619

[22] Filed: May 1, 1992

Related U.S. Application Data

[63] Continuation-in-part of Ser. No. 598,131, Oct. 16, 1990, Pat. No. 5,147,259.

[51] Int. Cl.[5] ..... A63B 21/00

[52] U.S. Cl. ..... 482/101; 482/135; 482/142; 482/145; 482/908

[58] Field of Search ..... 482/91-92, 482/97-103, 112-114, 128-130, 133-139, 142-145, 908; 128/28 R

[56] References Cited

U.S. PATENT DOCUMENTS

| | | | |
|---|---|---|---|
| 1,518,361 | 12/1924 | Ruden | 482/135 X |
| 1,548,849 | 8/1925 | Ruden | 482/135 X |
| 3,749,400 | 7/1973 | Stoffel | 482/130 X |
| 3,820,782 | 6/1974 | Salkeld | 482/101 |
| 3,887,180 | 6/1975 | Berman | 482/128 |
| 4,235,437 | 11/1980 | Bois et al. | 482/113 X |
| 4,500,089 | 2/1985 | Jones | 482/137 X |
| 4,542,900 | 9/1985 | Bay | 482/101 X |
| 4,600,189 | 7/1986 | Olschansky et al. | 482/100 |
| 4,627,619 | 12/1986 | Rockwell et al. | 482/137 |
| 4,629,185 | 12/1986 | Amann | 482/133 X |
| 4,632,393 | 12/1986 | Van Noord | 482/133 |
| 4,653,750 | 3/1987 | McIntyre | 482/134 X |
| 4,666,152 | 5/1987 | Jones | 482/137 |
| 4,702,108 | 10/1987 | Amundsen et al. | 482/133 X |
| 4,768,775 | 9/1988 | Marshall | 482/133 X |
| 4,799,671 | 1/1989 | Hoggan et al. | 482/100 |
| 4,848,740 | 7/1989 | VanDerHoeven | 482/133 |
| 4,854,578 | 8/1989 | Fulks | 482/137 X |
| 4,858,919 | 8/1989 | Jones | 482/137 |
| 4,951,943 | 8/1990 | Farenholtz | 482/102 X |
| 5,050,872 | 9/1991 | Farenholtz | 482/133 |
| 5,147,259 | 9/1992 | Hutchins | 482/135 X |
| 5,152,733 | 10/1992 | Farenholtz et al. | 482/101 X |

*Primary Examiner*—Robert Bahr
*Attorney, Agent, or Firm*—Warren L. Franz

[57] ABSTRACT

An exercise machine for strengthening the trunk muscles has a horizontally-movable plunger that contacts the trunk of a user for linearly applying the force of a weight stack to resist trunk flexion and extension of a seated user. The plunger is attached to a carriage mounted for horizontal movement on rails. A cable connection between the carriage and the weight stack includes a cam for varying resistance with changes in position of the plunger. The backrest and seat are made optionally tiltable.

18 Claims, 2 Drawing Sheets

LINEAR MOVEMENT, TRUNK MUSCLE EXERCISE MACHINE

This is a continuation-in-part of copending U.S. patent application Ser. No. 07/598,131, filed Oct. 16, 1990, now U.S. Pat. No. 5,147,259 entitled "Abdominal Muscle Exercise Machine," the disclosure of which is incorporated herein by reference.

BACKGROUND OF THE INVENTION

This invention relates to an exercise machine for strengthening muscles associated with the trunk; and, in particular, to apparatus for applying a variable resistance linearly to the trunk to oppose trunk extension or flexion involving contraction and/or uncontraction of trunk musculature.

The muscles associated with flexion/extension of the trunk (hereafter "trunk muscles") comprise both back and abdominal muscular structures. Posterior trunk extension, for example, involves the erector spinae muscles which, together with its prolongations, fill up the vertebral groove on each side of the spine. Lateral trunk flexion to either the right or left involves the principal abdominal structures (external or descending obliques, internal or ascending obliques, transversalis and abdominal rectus), as well as the latissimus dorsi and other more minor trunk/abdominal structures. The trunk muscles can be exercised by contraction (shortening) or release (lengthening) under load. The term "uncontraction" is used herein to offset the implied exertional volition of "contraction," and indicates a controlled release and muscular assertion during lengthening.

Applicant's copending U.S. patent Application Ser. No. 07/598,131 describes an exercise machine and method for strengthening the abdominals through anterior trunk flexion using a linearly movable plunger directed against the back to apply a variable resistance to the trunk to oppose the flexion. The '131 device includes means to restrain arm and leg movement in order to minimize the involvement of hip flexion. Early experience with linearly applied resistance using the '131 device has been favorable; and, though the '131 device is readily usable for other than anterior flexion, the present application addresses further developments of the linear resistance application method, and addresses exercise machine embodiments particularly suited for posterior trunk extension and lateral trunk flexion.

SUMMARY OF THE INVENTION

It is an object of the present invention to provide an exercise machine for strengthening the abdominal muscles as well as the back muscles through contraction-/uncontraction of the abdominal/back muscles against the opposing force of a variable resistance applied linearly to the trunk.

It is a further object of the invention to provide a linear movement, abdominal/back muscle exercise machine of the type described in Applicant's copending U.S. patent application Ser. No. 07/598,131, and which is particularly suited to strengthening the abdominal muscles through lateral flexion and the back muscles (erector spinae) through extension of the trunk.

In one aspect of the invention, an exercise machine comprises a movable member that contacts the trunk of a user and is displaced linearly to apply an opposing variable force to resist flexion or extension of the trunk. In a preferred embodiment, described in greater detail below, the linearly movable member takes the form of a push-rod or plunger that has a pad at its free end which is positioned to contact the rectus or oblique/transversalis muscle regions of the user. The machine includes a height adjustable seat and backrest, with swivel options, and means connecting a weight-selectable weight stack to the plunger to provide resistance that varies in a controlled manner according to the degree to which the plunger is moved as the user's trunk undergoes posterior extension or lateral flexion.

In operation, the user is seated either frontwise or sidewise facing the plunger with the padded end of the plunger touching the user's mid-ventral or mid-lateral trunk at either the front or side of the abdomen. As the user alternately contracts and uncontracts the abdominals while seated in a sideways positioning, the trunk is respectively laterally flexed and unflexed in a coronal plane. As the user alternately contracts and uncontracts his erector spinae while seated facing the plunger, the trunk is respectively extended and flexed in a sagittal plane. Some expansion of the abdominal wall occurs coincident with trunk extension against the plunger end. This causes the plunger arm to be moved linearly to lift the weight stack by an amount that varies with the distance the plunger is moved.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENT

Figure 1:
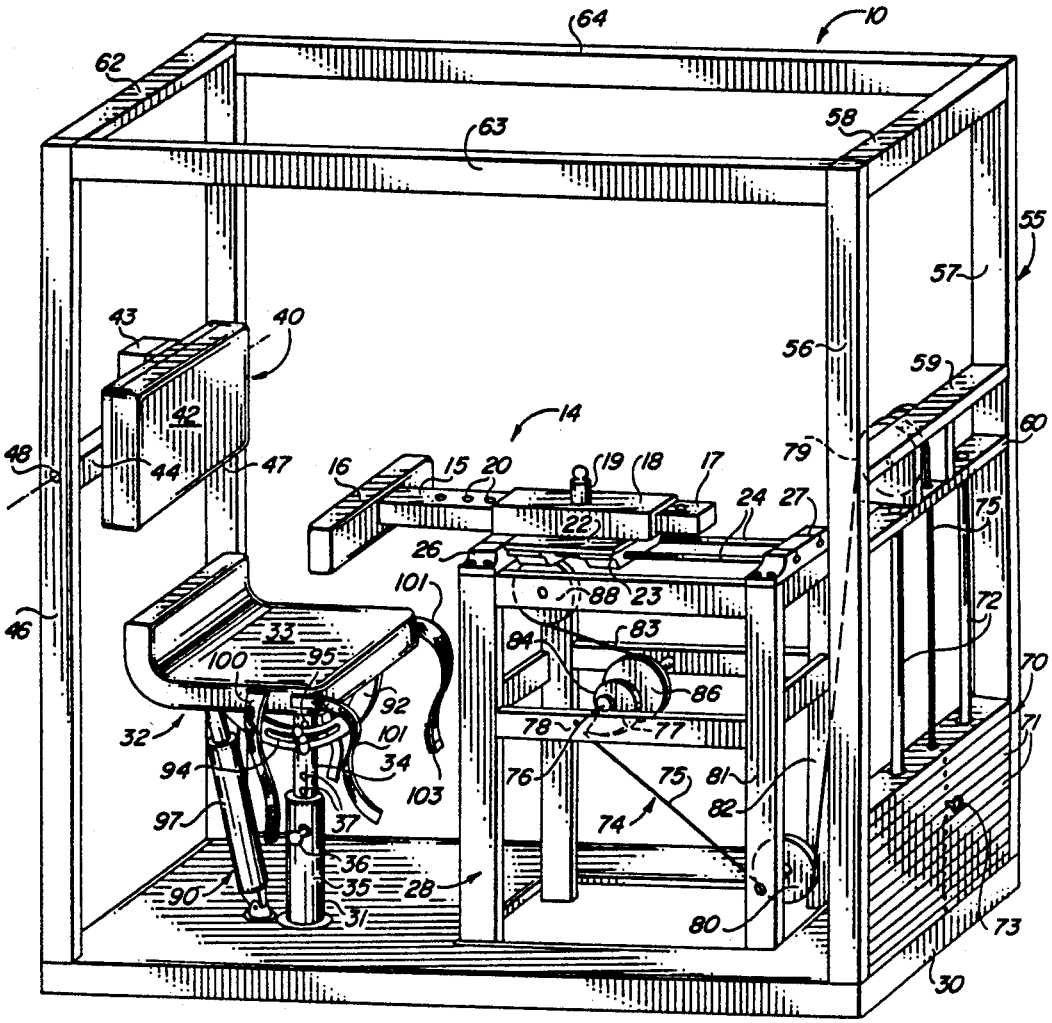
FIG. 1 is a perspective view of an abdominal muscle exercise machine constructed in accordance with the principles of the invention.

The principles of the invention are illustrated with reference to an abdominal/back muscle exercise machine 10 shown in FIG. 1 for linearly applying a resistance in a controlled variable way to the trunk of a user during contraction or lengthening of the abdominal muscles or the erector spinae muscles, depending upon the attitude of body positioning of the user. Contraction of the erector spinae muscles of the back corresponds to posterior extension, or backward arching, of the trunk. Lateral contraction of the abdominals corresponds to lateral flexion, or sideways flexion, of the trunk.

The apparatus 10 comprises a linear motion assembly 14 having a horizontally movable elongated push-rod or plunger 15, to a front free end of which is mounted a generally perpendicular, laterally extending pad 16. The plunger 15 includes coaxial telescoping inner and outer tubular members 17, 18 and means, such as a pin 19 attached to tube 18 engageable in a selected one of a plurality of holes 20 of tube 17, for fixing the length of extension of the padded end 16 relative to the tube 18. The tube 18 is mounted on a carriage 22 having bearing pillow blocks 23 arranged to transport the carriage 22 and the tube 18 longitudinally along spaced parallel horizontal rails 24. The opposite ends of the rails 24 are captured within aligned apertures of opposing end supports 26, 27 mounted in elevated position atop a framework 28 fixed at a front portion of a base 30. The assembly 14 may, for example, suitably be a double shaft, end supported linear motion system of the type commercially available from Thomson, Port Washington, N.Y.

A seat assembly 32, comprising a user supporting, generally horizontally disposed cushioned seat 33 supported in elevated position atop a vertical column 31. The column 31 includes coaxial inner and outer tubular members 34, 35, and is attached to the base 30 behind the framework 28. A pin 36 on member 35 cooperates with holes 37 on member 34 to provide adjustment of the height of seat 33 relative to the base 30 and, thus, vertically relative to the padded end 16 of plunger 15. The horizontal spacing of the seat assembly 32 relative to the pad 16 is controlled by the placement of pin 19 relative to the holes 20 of plunger 15.

A back rest assembly 40 is attached to base 30 in elevated relationship at the back of seat assembly 32. The assembly 40 includes a cushioned backrest 42, supported on a vertically extending column 43 which is carried on a horizontal, laterally extending cross member 44. Means, such as pin 45 similar to pins 19 and 36, is provided to enable vertical adjustment of the column 43 relative to the member 44 (see, FIG. 2A). The ends of member 44 are mounted between laterally spaced posts 46, 47 extending upwardly at the rear corners of base 30. The member 44 may optionally be made pivotable about a lateral axis passing through a pivotal connection 48. The height of the backrest 42 above the seat 33 is controlled by selecting the position of the column 43 relative to the cross-member 44.

Extending up from base 30 at the front of machine 10 is an open rectangular header 55, comprising laterally spaced front corner posts 56, 57 connected at upper ends by lateral crosspiece 58 and at vertically spaced intermediate elevations by lateral crosspieces 59, 60. A lateral crosspiece 62 similarly connects upper ends of the rear corner posts 46, 47; and upper ends of posts 46, 56 and 47, 57 are respectively joined by laterally spaced, longitudinally extending top runners 63, 64 in order to add rigidity to the overall structure of machine 10.

A conventional weight-selectable weight stack 70 is positioned in the gap between the posts 56, 57. The stack 70 comprises a plurality of weight elements 71 mounted for vertical movement on parallel laterally-spaced rails 72 whose opposite ends are respectively attached to the crosspiece 60 and base 30. A cable and pulley system 74 connects the weight stack 70 to the carriage 22 of the linear motion assembly 14. A first cable, chain or similar flexible lineal element 75 is fixed at one end to a selected number of weight elements 71 of stack 70, and is fixed at an opposite end to a point 76 on the perimeter of a cam 77 which is connected to a shaft 78 rotatably supported on the framework 28. Intermediate portions of the cable 75 are passed circumferentially around circular redirectional pulleys or sprockets 79, 80 which are respectively rotatably mounted between crosspieces 59, 60 at an intermediate elevation of header 55 and legs 81, 82 at the lower end of framework 28. A second cable, chain or similar flexible lineal member 83 has one end connected at a point 84 on the circumference of a pulley or sprocket 86 and another end connected to a point at the underside of carriage 22. The pulley 86 is coaxially mounted for rotation on shaft 78 adjacently secured to cam 77. An intermediate portion of the cable 83 passes circumferentially around a redirectional pulley or sprocket 88 which is rotatably mounted at the back upper end of framework 28.

The seat assembly 32 may optionally include a swivel mechanism 90 that enables the seat 33 to be tilted forwardly and backwardly about a pivotal connection 91 (see FIG. 2A) between the underside of seat 33 and the top of column 31. A depending arcuate member 92, having ends connected to seat 33 ahead and behind the connection 91, includes an arcuate slot 94. The shank of a threaded element 95 is passed through the slot into engagement with a threaded bore of the tubular member 34. Element 95 includes an enlarged head with radially extending projections that enables the element 95 to be hand-tightened to lock the arc 92 against movement relative to the column 31. When element 95 is loosened, the seat 33 can swivel within the limits defined by the travel of the shank of element 95 within the slot 94. In the illustrated embodiment, slot 94 subtends an arc of 30° to limit the swivel to ±15° from horizontal. The arcuate member 92 extends in a longitudinal plane to prevent side-to-side swiveling. To lock the seat 33 against swivel motion, element 95 is tightened down with seat 33 set at a desired fixed angle of tilt. A shock absorber or similar mechanism 97 is connected between the rear of seat 33 and the base 30, to damp the swivel motion of the seat about the point 91, to keep the swivel of the seat under control of the user.

Cam 77 may be a cam of the type known for conventional exercise machines which use a cable fixed to a cam, redirectional pulleys and a weight stack to provide balanced variable resistance against movement of a padded member by a user. The general size and shape of cam 77; radii of the redirectional pulleys; and angles and distances between cam and pulley rotational axes can be determined using known techniques according to a strength curve developed for the abdominal muscular structure being exercised.

Figure 2A:
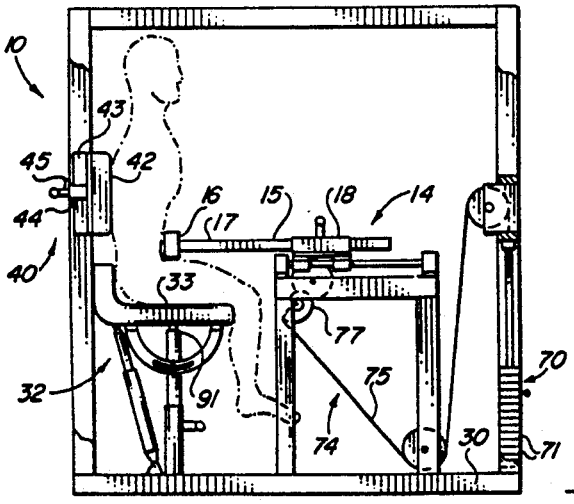
FIGS. 2A–4B are progressive schematic views helpful in understanding the operation of the machine of FIG. 1 in exercises involving posterior extension, lateral flexion and posterior extension with swivel, respectively.
Figure 2B:
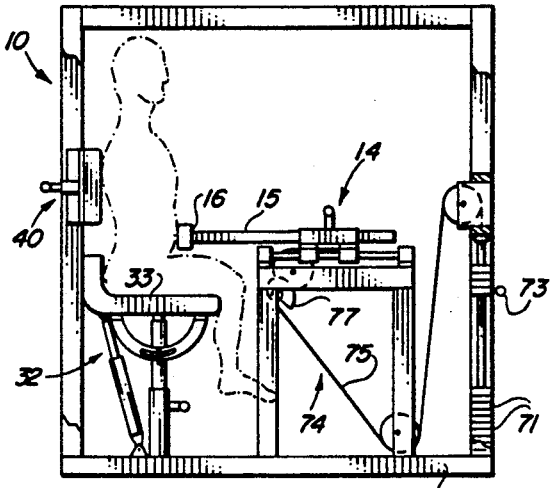

The operation of machine 10 for use in a lumbar extension, lower back (erector spinae) muscle strengthening exercise is illustrated with reference to FIGS. 2A–2B. FIG. 2A shows the user in the exercise start position; and FIG. 2B shows the user in the posterior extension position, with the torso extended backwards and the plunger 15 pushed forward to raise the selected part of the weight stack 70 at an elevation rate determined by the shape of cam 77.

The heights of seat 33 and backrest 42 are adjusted so that, in the start position (FIG. 2A), the user sits upright on cushion 33 with backrest 42 supporting the user's back in the dorsal/lumbar region, and with pad 16 contacting the user's mid-ventral trunk at the front of the abdomen. The user's thighs lie horizontally forwardly on seat 33, with knees bent to let the lower legs hang freely down ahead of the seat 33. The user's arms hang freely down at the user's sides. The position of the plunger inner member 17 is set relative to the plunger outer member 18 so that during backward extension of the trunk, the user's abdomen pushes against the plunger pad 16 to move the plunger arm 15 linearly forward on the carriage 22. This movement is opposed by the weight stack 70 which is attached to the carriage 22 by means of the cable and pulley system 74. As the carriage 22 advances, the effective radius of the cam 77 about which the cable 75 wraps varies, to vary the elevation rate of the weight stack. This varies the force resisting lined displacement of the plunger 15.

The plunger pad 16 is the primary contact between the body and the machine's resistance drive mechanism.

Although the shown drive mechanism 74 is a cable and pulley arrangement for applying gravitational force on a weight stack 70 in a controlled variable way, it will be appreciated that other resistance sources may also be used, including barbell-plate weight baskets, rubber cords, springs, and electromagnetic resistance engines.

The header columns 56, 57 can be provided with grid lines (not shown) to enable the user to visually judge the adequacy of the vertical stroke of the weight stack 70 in front of him due to movement of the plunger 15 during the posterior extension step of the exercise. It is preferable that the user arch his back slowly in accordance with the teachings of the Super Slow TM protocol originated by the inventor. Once the extension (FIG. 2B) has been achieved, the user reverses movement of the torso while the torso remains under load, by slowly bringing his spine and torso back into the FIG. 2A position.

Figure 3A:
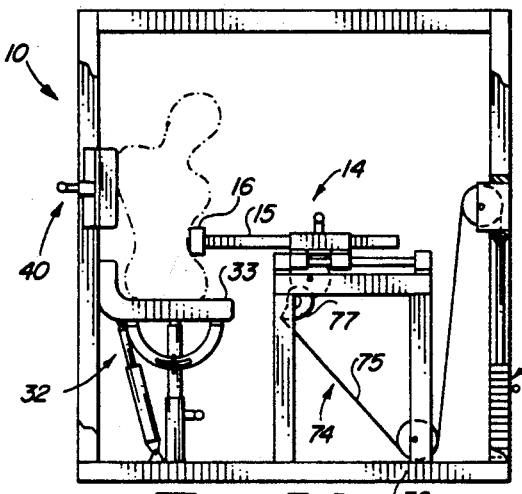
Figure 3B:
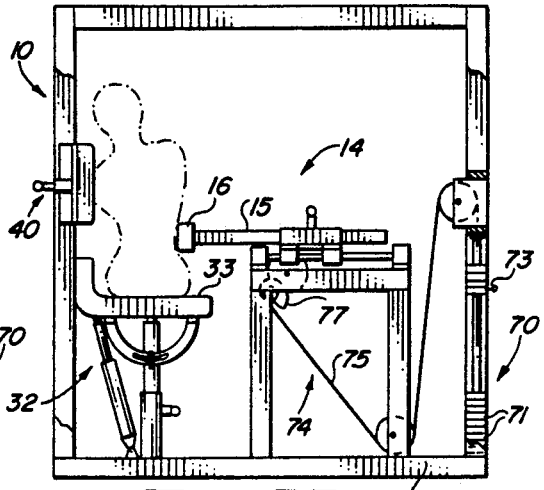

The operation of the machine 10 for use in a lateral flexion, abdominal muscle strengthening exercise is illustrated with reference to FIGS. 3A–3B. FIG. 3A shows the user in the exercise start position; and FIG. 3B shows the user in the lateral flexion position, with the trunk contracted sideways in the direction of flexion (bending toward the left in FIG. 3B). For lateral flexion, the user is seated sideways on seat 33, with plunger 16 contacting the user's side (right side in FIG. 3A) midway between the hips and shoulders, with the spine in a vertical or slightly oppositely flexed starting position. The user then flexes laterally toward the opposite side (left side in FIG. 3B), so the torso moves to the plunger pad 16 and plunger arm 15 forwardly (to the right in FIG. 3B) against the variable resistance of the weight stack 70 applied through the cable and pulley system 74. As with the posterior extension exercise, described previously, the variation in resistance is controlled by the changing effective radius of the cam 77 as the cam 77 is rotated.

Figure 4A:
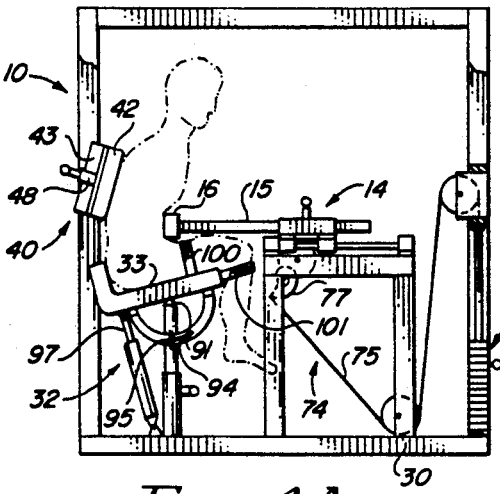
Figure 4B:
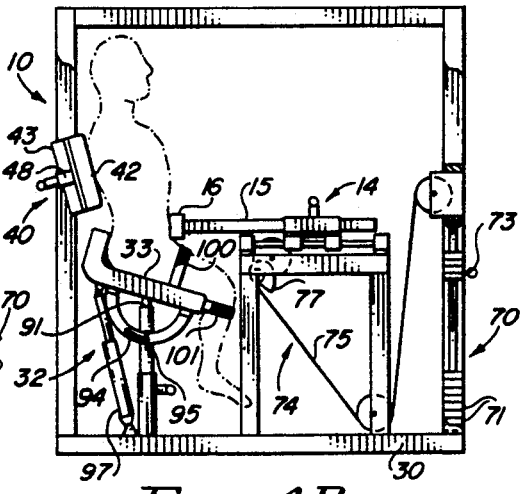

FIGS. 4A–4B illustrate the operation of machine 10 for a posterior extension exercise as in FIGS. 2A–2B, except where the seat 33 and backrest 42 are freed for pivoting. The user begins the exercise in the position shown in FIG. 4A, seated with the seat 33 tilted back, 15° counterclockwise about pivot point 91, with the element 95 in its rearmost position in arcuate slot 94. The user's trunk is flexed slightly forwardly, with the dorsal/thoracic region contacting the backrest 42 to tilt it forwardly (in the clockwise direction) about the pivot point 48. As with the non-swiveling, posterior extension exercise, the pad 16 is adjusted to contact the front of the abdomen. The user then contracts the erector spinae to extend the spine backwardly (lumbar extension) to the position shown in FIG. 4B, moving the plunger 15 linearly against the opposing variable resistance of the weight stack 70. The extension is, however, accompanied by a forward tilting (clockwise rotation about the point 91) of the seat 33 and backward tilting (counterclockwise rotation about the point 48) of the backrest 42. The seat 33 tilts forwardly until the element 95 reaches its forwardmost position of travel within the track 94. This exercise is generally the same as that of the straight lumbar extension exercise of FIGS. 2A–2B, except the tilting of the seat 33 and backrest 42 permits a wider range of movement. The shock absorber 97 serves to dampen the seat tilting motion, so that it does not occur too readily. To prevent the user from sliding forward in the seat 33 during the forward tilt, thigh and knee belts 100, 101 are provided on seat 33 to respectively go around the thighs and knees of the user. The belt ends are provided with adjustable fasteners, such as Velcro TM hook-and-eye fastener elements 103 (FIG. 1).

Those skilled in the art to which the invention relates will appreciate that the particular configurations of the linear motion assembly 14, seat assembly 32, backrest assembly 40, and header 55, and cable and pulley system 74 can be varied, and that various other substitutions and modifications can be made to the described embodiments without departing from the spirit and scope of the invention as described by the claims below.

What is claimed is:

1. An exercise machine for strengthening the trunk muscles of a user, said machine comprising:

a base having a front and a rear;

a seat;

means mounting said seat on said base;

a framework attached to said base adjacent said seat mounting means;

a header attached to said base at said front;

an elongated plunger having a free end dimensioned, configured and positioned for contacting the abdominal region of the trunk of the user seated on said seat;

means mounting said plunger on said framework, for horizontal movement of said plunger relative to said framework away from said seat in response to movement of the seated user's abdominal region applied to said free end;

a weight stack;

means mounting said weight stack on said header for vertical movement of said weight stack relative to said header; and means connecting said weight to said plunger for causing said weight stack to move vertically in response to said plunger horizontal movement away from said seat, so that said weight stack applies a force on said plunger to resist said movement by said user.

2. A machine as in claim 1, wherein said means mounting said seat includes swivel mechanism means for enabling said seat to be tilted forwardly and backwardly in a swivel motion about a pivot point.

3. A machine as in claim 2, wherein said means mounting said seat further includes means for releasably locking said seat against swivel motion, to selectively fix said seat at a desired fixed angle of tilt.

4. A machine as in claim 2, wherein said means mounting said seat further comprises means connecting said seat and said base to damp said swivel motion about said pivot point.

5. A machine as in claim 1, wherein said means mounting said seat comprises a column, a pivotal connection attaching said seat to said column, an element having an arcuate slot and being attached to said seat, and a fastener engaging said column through said slot.

6. A machine as in claim 5, wherein said slot subtends an arc of 30°.

7. A machine as in claim 5, wherein said slotted element extends in a longitudinal plane and functions to prevent side-to-side swiveling.

8. A machine as in claim 1, wherein said framework is mounted on said base ahead of said seat for movement of said plunger away from said seat in a forward direction in response to movement of the user's abdominal region applied to said free end.

9. A machine as in claim 8, further comprising a backrest, and means attaching said backrest to said base in elevated relationship behind said seat.

10. A machine as in claim 9, wherein said means attaching said backrest to said base includes means attaching said backrest for pivotal movement relative to said seat about a lateral axis.

11. A machine as in claim 10, wherein said means attaching said backrest to said base further includes means enabling vertical adjustment of said backrest relative to said seat.

12. A machine as in claim 1, wherein said connecting means comprises at least one rotary member, and at least one flexible lineal element connecting said stack weight through said rotary member to said plunger.

13. A machine as in claim 1, wherein said connecting means comprises a shaft mounted for rotation on said framework, a cam mounted on said shaft, a circular rotary member mounted on said shaft, a first flexible lineal element connecting said weight stack to one of said cam and rotary member, and a second flexible lineal element connecting the other of said cam and rotary member to said plunger.

14. A machine as in claim 1, further comprising means for selectively adjusting vertical and horizontal spacing between said seat mounting means and said plunger mounting means.

15. A machine as in claim 1, wherein said means mounting said seat includes swivel mechanism means for enabling said seat to be tilted forwardly and backwardly in a swivel motion about a pivot point; and slot means for limiting the amount of said tilting during said swivel motion about said pivot point.

16. An exercise machine for strengthening the trunk muscles of a user, said machine comprising:

a base having a front and rear;

a seat attached to said base at said rear;

a header attached to said base at said front;

a framework attached to said base intermediate said seat and said header;

an elongated plunger having a free end dimensioned, configured and positioned for contacting the abdominal region of the trunk of the user seated on said seat;

means mounting said plunger on said framework for horizontal movement of said plunger relative to said framework in response to movement of the seated user's abdominal region applied to said free end;

a weight stack;

means mounting said weight stack on said header for vertical movement of said weight stack relative to said header; and means connecting said weight stack to said plunger for causing said weight stack to move vertically in response to said plunger horizontal movement, so that said weight stack applies a force on said plunger to resist said user movement;

said connecting means comprising at least one rotary pulley, a rotary cam, and at least one flexible lineal element connecting said weight stack to said plunger through said pulley and said cam, so that said force is applied on said plunger in a varying way in accordance with the shape of said cam.

17. A machine as in claim 16, further comprising a column, said seat being attached to said base by pivotal attachment to said column, a swivel mechanism element having an arcuate slot and being attached to said seat, and a fastener engaging said column through said slot for enabling said seat to be tilted forwardly and backwardly in a swivel motion about said pivotal attachment through an arc limited by said arcuate slot.

18. An exercise machine for strengthening the trunk muscles of a user, said machine comprising:

a base having a front and a rear;

a seat;

means mounting said seat on said base; including swivel mechanism means for enabling said seat to be tilted forwardly and backwardly in a swivel motion about a pivot point, and means connecting said seat and said base to damp said swivel motion about said pivot point;

an elongated plunger having a free end dimensioned, configured and positioned for contacting the abdominal region of the trunk of the user seated on said seat;

means mounting said plunger on said base adjacent said seat, for horizontal movement of said plunger relative to said base away from said seat in response to movement of the seated user's abdominal region applied to said free end;

a weight; and means mounted on said base connecting said weight to said plunger for causing said weight to move in response to said plunger horizontal movement away from said seat, so that said weight applies a force directed toward said seat on said plunger during said plunger horizontal movement, to resist said movement by said user's abdominal region.

* * * * *